US005692719A

United States Patent [19]

Shepherd

[11] Patent Number: 5,692,719

[45] Date of Patent: Dec. 2, 1997

[54] SHEET MUSIC STAND

[75] Inventor: Charles G. Shepherd, Oakville, Canada

[73] Assignee: Tod G. Petersen, Calgary, Canada

[21] Appl. No.: 541,351

[22] Filed: Oct. 10, 1995

[51] Int. Cl.[6] ..... A47B 97/04

[52] U.S. Cl. ..... 248/460; 248/188.7; 248/441.1; 248/448

[58] Field of Search ..... 248/460, 441.1, 248/447, 459, 463, 464, 465, 411, 413, 414, 161, 163.1, 165, 166, 168, 167, 170, 188.7, 528

[56] References Cited

U.S. PATENT DOCUMENTS

| | | | |
|---|---|---|---|
| 645,527 | 3/1900 | Latourell et al. | 248/188.7 |
| 1,448,171 | 3/1923 | Waderlow | 248/170 |
| 1,862,562 | 6/1932 | Aldeen et al. | 248/447 |
| 2,474,532 | 6/1949 | Kitchen | 45/121 |
| 4,610,417 | 9/1986 | Kuss | 248/460 |
| 5,037,057 | 8/1991 | Andrews | 248/460 |
| 5,078,353 | 1/1992 | Linn | 248/166 |
| 5,114,111 | 5/1992 | Andrews | 248/460 |
| 5,356,109 | 10/1994 | Biasini | 248/448 |

*Primary Examiner*—Ramon O. Ramirez
*Assistant Examiner*—Anita M. King
*Attorney, Agent, or Firm*—Rogers & Scott

[57] ABSTRACT

The invention provides a stand for sheet music which includes a music support having a platen for carrying the music, a telescopic post for adjusting the height of the platen, and a base supporting the post and having collapsible legs. The post and music support are coupled to one another such that the support can be tilted relative to the post so that the music can be displayed at various heights and at various angles to the vertical. The music support is collapsible for movement between a deployed position and a stored position to minimize the size of the music support for transporting the stand.

11 Claims, 5 Drawing Sheets

SHEET MUSIC STAND

FIELD OF THE INVENTION

This invention relates to collapsible stands of the type used by musicians to hold sheet music at a convenient height and orientation so that the musician can see the music while playing a musical instrument. The stand can also be used as a collapsible lectern.

BACKGROUND OF THE INVENTION

The invention will be described with reference to use by musicians. However, it will be evident that the invention can be used by anyone who wishes to display papers or a book at a convenient height.

It has become common practice for musicians to use music stands to display sheet music while the musicians play their various instruments. The stands usually allow for height adjustment so that the music can be placed at the most advantageous height and many of these stands are collapsible to allow the musician to reduce the size of the stand to fit in a case or relatively small carrying bag. However, the structures tend to be flimsy, easily deformed, and they do not provide a continuous surface to support the sheet music.

The present invention is intended to provide an improved collapsible stand particularly for use by musicians but which has other uses.

SUMMARY OF THE INVENTION

In one of its aspects, the invention provides a stand for sheet music which includes a music support having a platen for carrying the music, a telescopic post for adjusting the height of the platen, and a base supporting the post and having collapsible legs. The post and music support are coupled to one another such that the support can be tilted relative to the post so that the music can be displayed at various heights and at various angles to the vertical.

In another of its aspects the music support is collapsible for movement between a deployed position and a stored position to minimize the size of the music support for transporting the stand.

These and other aspects of the invention will be better understood from the following description and drawings.

DESCRIPTION OF THE PREFERRED EMBODIMENT OF THE INVENTION

Figure 1:
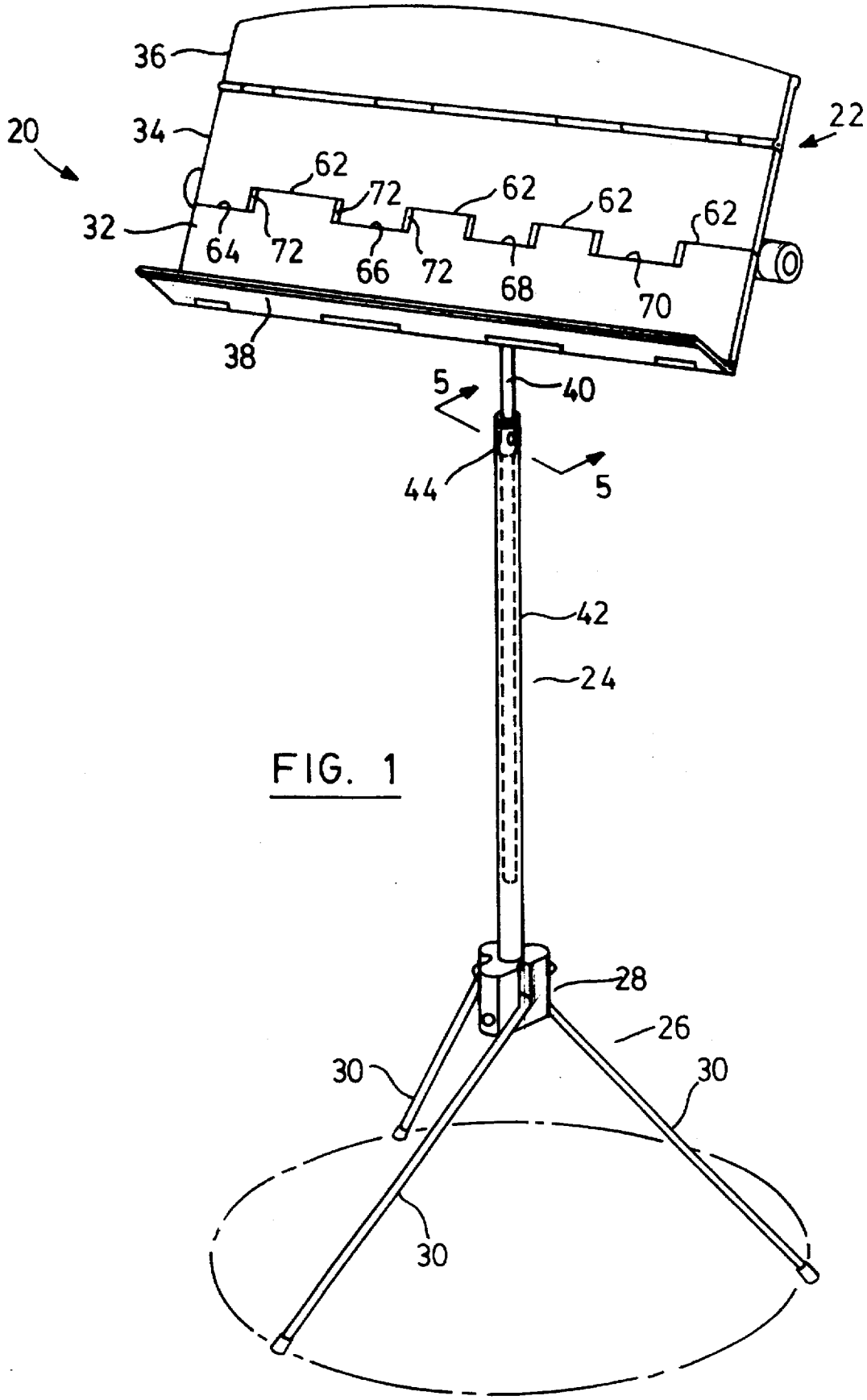
FIG. 1 is an isometric view from the front of a stand for sheet music and the like in accordance with a preferred embodiment of the invention and showing the stand and its parts in a deployed position.

Reference is first made to FIG. 1 which illustrates a stand designated generally by the numeral 20 and consisting essentially of a support 22 proportioned to support sheet music. The support is carried on the upper end of a telescopic post 24 which projects upwardly from a base 26 including a hub 28 and three collapsible legs 30.

The music support 22 is in the form of a flat platen when deployed as shown in FIG. 1 and consists essentially of generally rectangular first and second parts 32, 34 pivotally connected to one another about a first axis. The second part 34 is also pivotally connected to an extension 36 about a parallel second axis. The first part 32 is also pivotally connected about a further parallel axis to a ledge 38 for supporting the lower edge of sheet music which rests against the parts 32, 34 and the extension 36. As will be described, the pivotal connections permit the music support to be collapsed from the deployed position shown in FIG. 1 into a stored position seen in FIG. 8.

The telescopic post consists of a cylindrical upper portion 40 which is a sliding fit within a lower portion 42 and is frictionally engaged in this portion at a telescopic joint 44 which will be explained in more detail with reference to FIG. 5.

The bottom end of the lower portion 42 is a close sliding fit in the hub 28 and is held in place on assembly by the legs 30 as will be explained. The legs are moveable angularly relative to the hub between the deployed position shown in FIG. 1 and a collapsed position which will be described later and which can be seen in ghost outline in FIG. 6.

It will be evident from FIG. 1 that a musician can adjust the height of the support 22 by moving the upper portion 40 of the telescopic post 24 relative to the lower portion 42. This adjustment can be made by simply applying a force to slide the portion relative to one another. As will be described, the music support 22 can also be tilted as desired.

Figure 2:
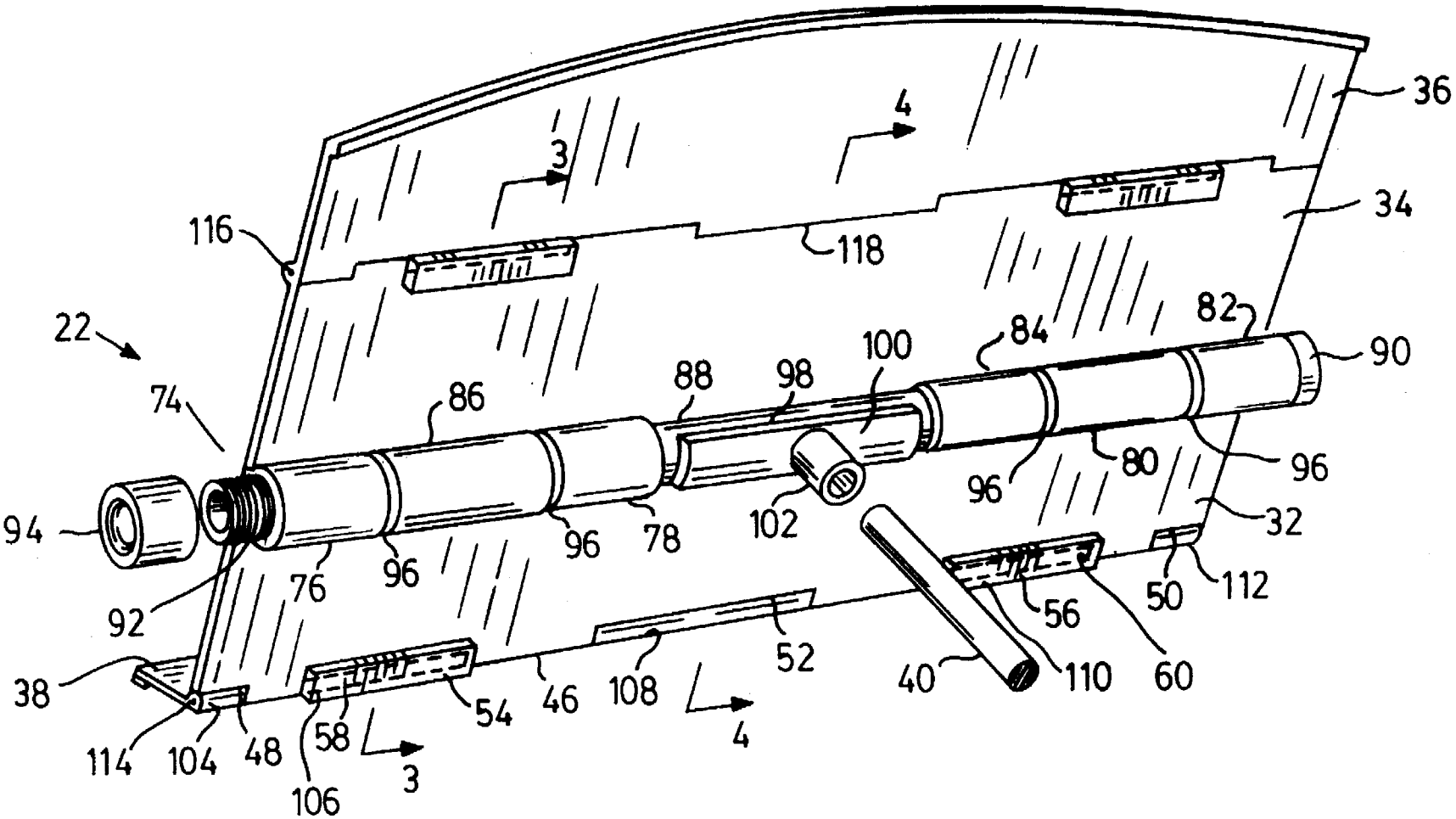
FIG. 2 is an isometric view from the rear of a support for the sheet music (drawn to a larger scale than that used in FIG. 1) and forming part of the stand, parts being removed and broken away to show structure.

Reference is next made to FIGS. 1 and 2 with particular reference to FIG. 2 to describe the music support 22. A comparison of parts 32 and 34 will show that these parts are in fact identical. The part 32 will be described in detail. A first edge 46 (the lower edge as drawn) is discontinuous and defines a pair of end cutouts 48, 50 and a central cutout 52. These cutouts are of similar vertical extent as drawn and a pair of stops 54, 56 are integrally formed to cover respective intermediate cutouts 58, 60 for purposes which will be described.

As can be seen in FIG. 1, the first part 32 includes a second or upper edge 62 which also defines cutouts. First of all there is an end cutout 64 and three more cutouts 66, 68 and 70. The edge 62 and associated cutouts are arranged so that when the similar second part 34 is brought into engagement in an inverted position with the first part 32, there is an interlock with small clearance spaces 72 provided to permit some axial movement along an axis of a pivot joint 74 which is better seen in FIG. 2. This pivot joint is made up of journals 76, 78, 80 on the first part 32 which engage between corresponding journals 82, 84 and 86 on the second part 34. The journals are shaped so that a tubular pivot shaft 88 is a sliding fit within the journals. The pivot shaft includes a fixed cap 90 at one end and at the other end, a threaded portion 92 receives a barrel nut 94. This nut can be tightened to cause slight axial movement between the first and second parts 32, 34 to bring the journals towards one another to nip a series of similar resilient rings 96. This axial adjustment gives a frictional quality to the angular movement between the parts 32, 34 about the pivot shaft 88.

After assembly, the pivot shaft receives a connector 98 having a base 100 formed for attachment to the shaft 88 and a tubular socket 102 for receiving an upper extremity of the upper portion 40 of the telescopic post 24 (FIG. 1). Because the base 100 is effectively part of the pivot shaft 88, the socket 102 can be moved angularly to adjust the angular position of the music support 22 on the telescopic post 24.

Returning to the first edge 46 of the first part 32, the cutouts provided in this edge mate with respective bosses 104, 106, 108, 110 and 112. Portions of the lower part between the cutouts define a bore to receive a continuous pivot pin 114 which is frictionally engaged in the bosses to permit angular movement between the ledge 38 and the lower part 32. However, this angular movement is limited as illustrated in FIGS. 3 and 4.

Figure 3:
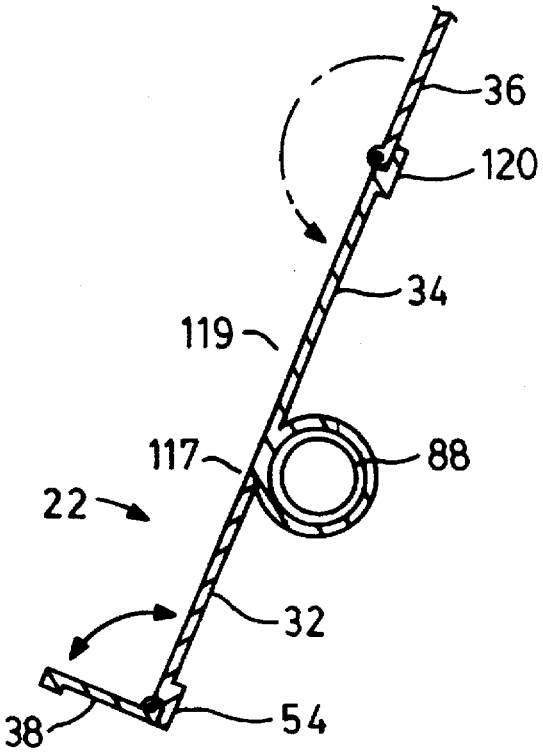
FIG. 3 is a sectional view on line 3—3 of FIG. 2.
Figure 4:
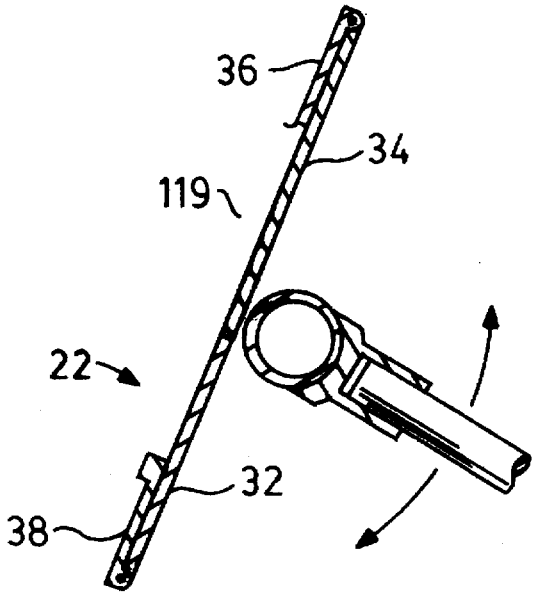
FIG. 4 is a sectional view generally on line 4—4 of FIG. 2.

As seen in FIG. 3, which is a sectional view on line 3—3 of FIG. 2, the ledge 38 is positioned at about 90 degrees from the first part 32 and the downward movement has been stopped by physical engagement with the stop 54 (and of course with the similar stop 56 seen in FIG. 2). When it is desired to move the ledge 38 from the deployed position shown in FIG. 3 to a stored position, it is moved upwardly, as is indicated by the arrow shown in FIG. 3, ending in the position shown in FIG. 4.

Returning to FIG. 2, it will be evident that a pivot pin 116 between the second part 34 and the extension 36 is similar to pivot pin 114. Also, because the first and second parts 32, 34 are similar, the pivot pin 116 passes through a similar arrangement to that found along the length of pin 114. In other words, an edge 118 of the extension 36 is similar to an edge of the ledge 38 containing the pin 114. The pivotal action is the same in all respects except that the extension is free to move between the deployed position shown in FIG. 2 and a stored position shown in FIG. 4.

It can be seen in FIG. 3 that in the deployed position, the parts 32, 34 and extension 36 define a flat platen having a planar front surface indicated by the numeral 119 in FIG. 3. This arrangement is controlled by the first part 32 coming into engagement with the second part 34 at abutments 117 adjacent the pivot shaft 88, and the extension 36 meeting the stops 120 on the second part 34. To collapse the structure, the second part 34 is rotated clockwise in relation to the first part 32 (as drawn in FIG. 3) and the extension 36 is rotated in an anti-clockwise direction. As previously described, the ledge 38 is rotated and this is in a clockwise direction as shown in FIG. 3.

The stored position will be described in more detail with reference to FIG. 8.

It will now be evident from the foregoing description that the music support provides a platen having a planar surface 119 (FIG. 3) on which sheet music can be placed supported on the ledge 38. The angle to the vertical can be adjusted by moving the stand about the axis of the pivot shaft 88 and the height of the music support can be changed, as is about to be described, by adjusting the telescopic post 24.

Figure 5:
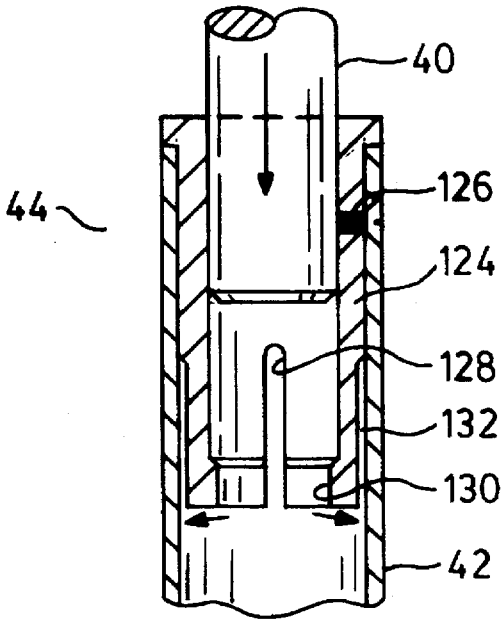
FIG. 5 (drawn adjacent FIG. 1) is a sectional view on line 5—5 of FIG. 1 and drawn to a larger scale.

Reference is now made to FIGS. 1 and 5 to describe the adjustment of telescopic post 24. As seen in FIG. 5, the upper portion 40 and lower portion 42 are connected at the telescopic joint 44 consisting of a sleeve 124 held in place by a set screw 126 passing through the wall of the lower part 42. The set screw is not in engagement with the upper portion 40 which is a frictional fit in the sleeve 124. The frictional resistance is enhanced by the use of a lower portion of the sleeve of reduced outside diameter and which is divided by longitudinal slits 128 and which has a restricting neck 130. As the upper portion 40 is pushed downwardly, it will dilate the neck 130 and the deformation will apply a load resulting in a frictional force between the sleeve 124 and the portion 40. The amount of friction depends upon the shape of the sleeve and the neck 130 which is free to deform because of an annular space 132 existing around the lower part of the sleeve.

Figure 6:
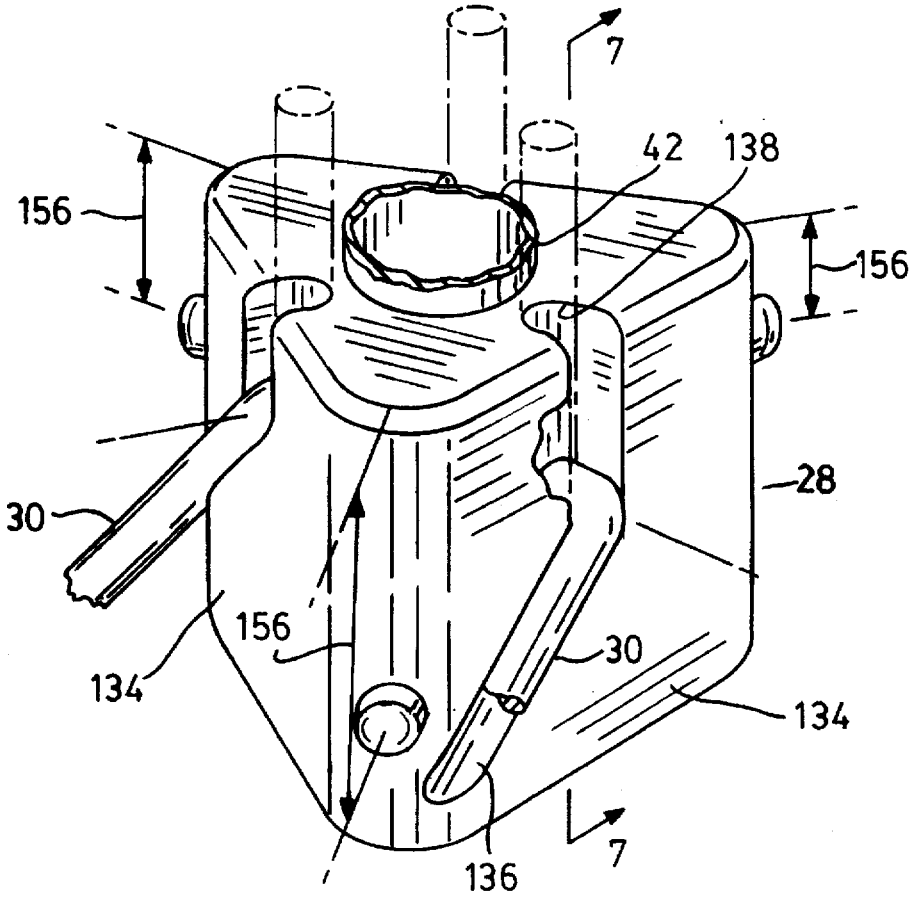
FIG. 6 is an isometric view of a hub forming part of the sheet music stand and drawn to a larger scale than that used in FIG. 1.

Reference is next made to FIG. 6 to describe the hub 28 which, as previously mentioned, is a sliding fit on a lower end of the lower portion 42 of the telescopic post 24 (FIG. 1).

The hub 28 has a generally triangular cross-section in plan view defining three faces 134, two of which can be seen in FIG. 6. Each of the faces is associated with one of the three similar legs 30. One of the legs 30 in the foreground of FIG. 6 is typical of all three legs and will be described in detail. This leg is sitting in an elongate detent 136 angled relative to the axis of the post and formed in the associated face 134 of the hub 28 to locate the leg in an angled deployed position. There is also a storage recess 138 extending relative to the post and formed in the related one of the faces 134 to receive the leg in the stored position as will be described.

Figure 7:
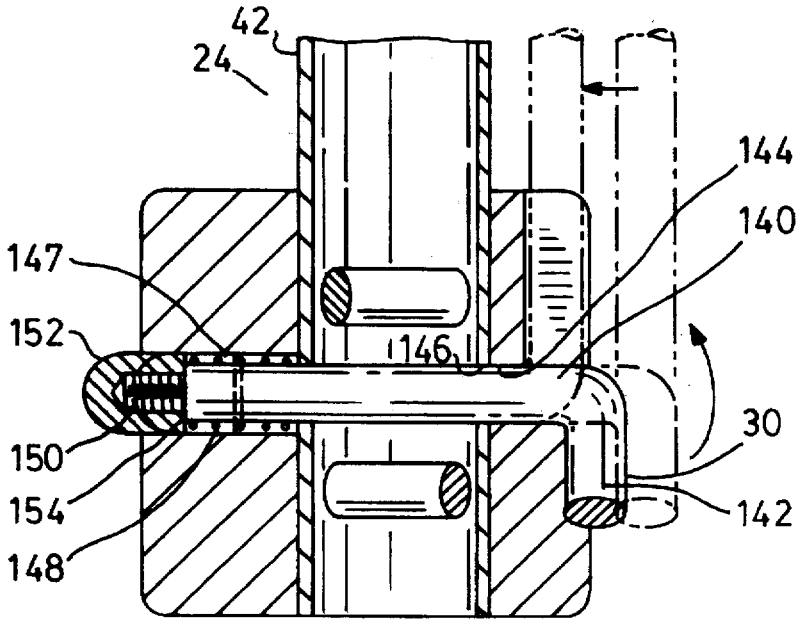
FIG. 7 is a sectional view on line 7—7 of FIG. 6.

FIG. 7 is a sectional view on line 7—7 of FIG. 6 showing more detail of the leg seen in the foreground of FIG. 6. This leg has an end portion 140 extending at right angles to a main portion 142 and positioned generally at right angles to the upright axis of the telescopic post 24. The end portion 140 projects through an opening 144 in the hub and through a corresponding opening 146 formed in the tubular lower portion 42 of the telescopic post. As a result, the post and hub are locked together.

The end portion 140 of exemplary leg 30 extends through the lower portion 42 and enters a further opening 147 in the hub which is larger than the diameter of the end portion 140 to make room for a compression spring 148 located about the end portion and within the opening 146. The portion 140 terminates in a end part 150 which receives a threaded cap 152 which is in tight engagement with a shoulder 154 where the threaded end part 150 meets the remainder of the end portion 140. The spring 148 in opening 147 is trapped to bias the end portion 140 to the left as drawn and into engagement with the detent 136 (FIG. 6) and the cap 152 is a sliding fit in the opening 147 to permit axial movement as the spring is compressed.

The cap 152 is made to project outwardly of the hub so that a force on the cap will push the leg out of the detent 136 and allow it to be rotated from the deployed position shown in full outline to the stored position shown in ghost outline. Similarly the cap can be used to move the leg out of the storage recess 138.

It will be evident that because the end portion 140 of the leg 30 passes through the lower portion 42 of the telescopic post, the end portions 140 of all three legs can not lie in the same plane. It is arranged therefore to have a leg above and below the leg shown in FIG. 7 and as a result the locations of the legs are different as indicated by the measurement arrows 156 seen in FIG. 6. However it will be appreciated that because the legs are all the same, the angular dispositions of the detents 136 must be slightly different from one another for the legs to support the post vertically when the legs are on a horizontal surface.

As mentioned previously, the stand 20 shown in FIG. 1 is in a deployed position. To convert it to a stored position, the legs are moved individually by pushing the respective caps 152 so that the legs can be rotated individually out of the corresponding detents 136 (FIG. 6) and into the positions shown in ghost outline in FIG. 6 where they engage within the recesses 138. The telescopic post can be reduced in length simply by pushing it downwardly to bring the upper portion 40 into the lower portion 42 and the music support 22 is removed from the post. The support can then be collapsed by folding the ledge 38 upwardly and into engagement with the first part 32, folding the extension 36 forwardly, and then rotating the first and second parts 32, 34 about the pivot shaft 88 which, because it is offset behind the front surface 119 (FIG. 3) will create a space to accommodate the post and legs for ready storage as seen in FIG. 8.

Figure 8:
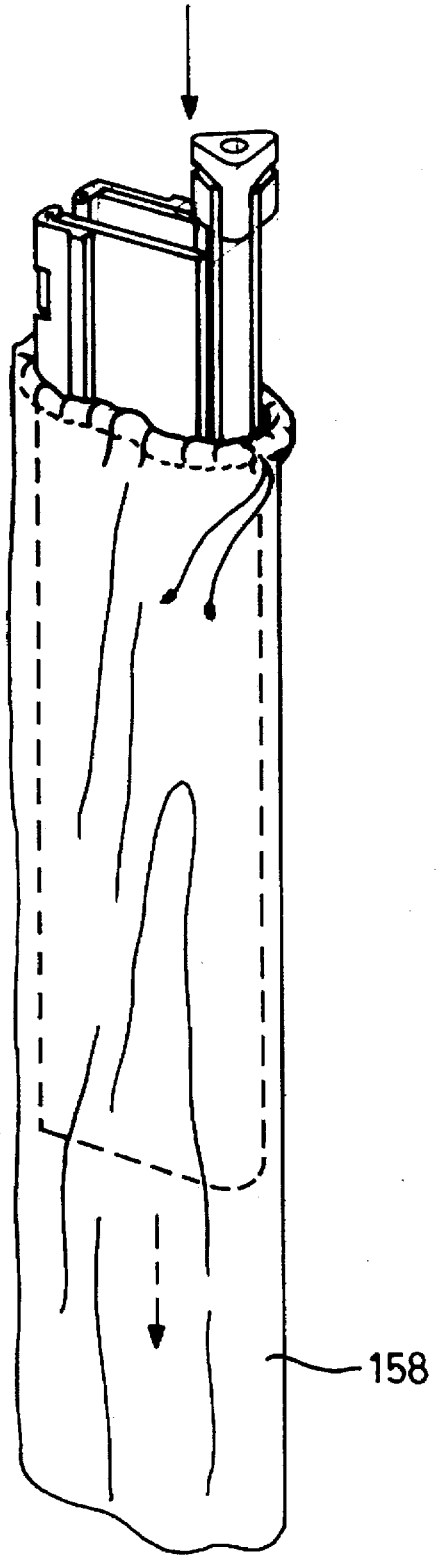
FIG. 8 is an isometric view illustrating the sheet music stand in a stored position.

Reference is now made to FIG. 8 which shows the stand in a stored position and arranged for carrying in an optional bag 158. One of the advantages of the stand is that the post 24 (FIG. 1) is proportioned to slide inside the tubular pivot shaft 88 (best seen in FIG. 2). To permit this arrangement, the legs 30 in the stored position (seen in ghost outline in FIG. 6) are parallel to the shaft 24 but spaced from it sufficient to receive the parts 32, 34 of the support 22 as the shaft is shifted into the tubular pivot shaft. The resulting arrangement facilitates carrying the stand, and if preferred, the bag 158 can be used to protect the stand and retain the parts in position.

The stand may be made from any suitable materials, as would be evident to a person skilled in the art. The preferred materials used by the applicant are: polypropylene for the support 22; extruded aluminium for the upper and lower portion 42, 44 of the post; injection moulded nylon for hub 28; steel for the legs; 30 neoprene for the friction rings 96; and acetyl resin for the friction element in the post 24. The pivot shaft 88 is ABS and the caps and boss are also ABS and solvent welded to the extruded shaft. It will be evident to those skilled in the art that the invention can take many forms and that such forms are within the scope of the invention as claimed.

I claim:

1. A stand of the type used to display sheet music for a musician, the stand providing:

a support including a platen having a front and rear and including first and second parts, a pivotal connection between the first and second parts for providing relative movement of the first and second parts about a pivot axis spaced rearwardly of the rear of the platen for relative movement of the first and second parts between a deployed position in which the front is planar and a stored position in which the parts are generally parallel with one another, the pivotal connection having a tubular pivot shaft and the pivotal connection exhibiting frictional resistance so that said parts will tend to remain in either the deployed or stored positions;

the support including a socket;

a post having upper and lower ends, the upper end being adapted to be releasably engaged in the socket, and the tubular pivot shaft being proportioned to slidably receive the post for storage; and a base including a hub coupled to said lower end of the post and at least three legs pivotably coupled to the hub for movement selectively between a stored position in which the legs are alongside the post, and a deployed position in which the legs are positioned to support the stand on a horizontal surface to position the platen to receive sheet music and the like.

2. A stand as claimed in claim 1 in which the support further comprises a ledge, the ledge and platen defining a pivotal connection for relative movement between a collapsed position in which the ledge is parallel to the platen and a deployed position generally at right angles to the platen.

3. A stand as claimed in claim 1 in which the post is telescopic and comprises upper and lower parts and a telescopic joint connecting the upper and lower parts and providing for relative longitudinal movement to adjust the height of the platen in the deployed position.

4. A stand as claimed in claim 1 in which the hub defines detents, one for each leg, and in which the hub and legs include biassing structure to retain the legs in the detents when the legs are in the deployed position.

5. A stand as claimed in claim 4 in which the hubs further define storage recesses in which the legs are located by the biassing structure when the legs are in a stored condition.

6. A stand as claimed in claim 1 in which said socket is attached to the pivot shaft so that the socket can be rotated about the pivot axis to change the orientation of the platen.

7. A stand of the type used to display sheet music for a musician, the stand comprising:

a support including first and second generally rectangular pans having journals adjacent an edge of the parts, the journals being arranged to inter-engage, a tubular pivot shaft extending through the journals for relative angular motion of the first and second parts against frictional resistance between a deployed position in which the parts combine to define a substantially planar front surface on the support, and a stored position where the parts are spaced apart by substantially the extent of the journals and in parallel relationship and a ledge hingeably connected to the first pan for angular movement about an axis parallel to the axis of the pivot shaft for movement of the ledge between a deployed position generally at right angles to the first part, and a stored position where the ledge is flat against said front face;

a telescopic post having an upper pan and a lower part and a joint between the parts permitting longitudinal adjustment of the parts to vary the length of the post;

a socket attached to the pivot shaft substantially at the mid point of the longitudinal extent of the pivot shaft and adapted to releasably receive an upper end of the telescopic post; and a base including a hub coupled to a lower end of the telescopic post and including at least three legs adjustably coupled to the hub for movement between a deployed position for supporting the stand on a horizontal surface with the telescopic post vertical and a stored position adjacent to and parallel with the post, whereby in use the support can be adjusted for height by adjusting the post and for angle by rotating the first and second pans of the support about the pivot shaft, and whereby the stand can be collapsed for transporting the stand by placing the legs in the stored position, adjusting the post to a minimum length, releasing the support and placing it in the stored position, and then placing the post inside the tubular pivot shaft.

8. A stand as claimed in claim 7 in which the support further comprises an extension pivotably attached to the second part for movement from a deployed position in which the support expands said planar front surface and a stored position in which the extension is flat against the second part.

9. A stand as claimed in claim 7 and further comprising rings positioned about the pivot shaft and between respective journals on said first and second parts to provide said frictional resistance.

10. A stand of the type used to display sheet music for a musician, the stand comprising:

a support including a platen defining a planar front surface, a ledge at a lower edge of the front surface, and a pivot shaft frictionally coupled to the platen;

the platen including first and second similar pans, and each of the similar parts having journals receiving the pivot shaft so that the parts can be moved angularly with respect to one another;

a telescopic post having first and second ends and being releasably coupled at said first end to the pivot shaft so that the platen can be adjusted angularly relative to the post; and a base coupled to said second end of the telescopic post and including legs for supporting the stand on a horizontal surface with the telescopic post vertical.

11. A stand as claimed in claim 10 in which the pivot shaft is tubular to receive the telescopic post when the stand is stored.

* * * * *